US006041442A

United States Patent [19]

Owen

[11] Patent Number: 6,041,442

[45] Date of Patent: Mar. 28, 2000

[54] GARMENT

[75] Inventor: Carol A. Owen, Boulder, Colo.

[73] Assignee: Mountain Hardwear, Berkeley, Calif.

[21] Appl. No.: 09/323,515

[22] Filed: Jun. 1, 1999

[51] Int. Cl.[7] ..... A41D 1/06

[52] U.S. Cl. ..... 2/228; 2/227; 2/238; 2/69

[58] Field of Search ..... 2/227, 228, 238, 2/79, 69; 450/94, 95, 97, 100, 101, 104, 105, 112, 115, 116, 117

[56] References Cited

U.S. PATENT DOCUMENTS

| | | | |
|---|---|---|---|
| 2,663,876 | 12/1953 | Miller et al. . | |
| 3,435,462 | 4/1969 | Bank . | |
| 3,813,697 | 6/1974 | Belpaume . | |
| 4,462,118 | 7/1984 | Bowditch . | |
| 4,805,243 | 2/1989 | Gibbens et al. | 2/228 |
| 4,961,233 | 10/1990 | Black | 2/228 |
| 5,297,296 | 3/1994 | Moretz et al. . | |
| 5,435,014 | 7/1995 | Moretz et al. . | |
| 5,598,586 | 2/1997 | Munjne | 2/237 |

*Primary Examiner*—Gloria M. Hale
*Attorney, Agent, or Firm*—Thomas R. Lampe

[57] ABSTRACT

A garment for wear by an individual includes an upper garment portion of one-piece construction having a truncated cone-like appearance and including a hip covering segment. The segment has areas free of join seams positionable over the hip bones of an individual's hips when the garment is worn. A lower garment portion is connected to the upper garment portion and is positioned about the wearer's legs. In the disclosed embodiment of the invention, a liner of wicking material also of one piece construction and having a truncated cone-like appearance is located inside the upper garment portion, the liner being free of join seams in the vicinity of the segment areas of the upper garment portion.

20 Claims, 6 Drawing Sheets

GARMENT

TECHNICAL FIELD

This invention relates to a garment to be worn by an individual. The garment incorporates features adding to the individual's comfort when he or she carries a backpack or wears any kind of hip engaging belt. The embodiment of the invention disclosed herein is in the form of a pair of shorts; however, the principles of the invention are also applicable to long trousers or pants and skirts or skirt-like garments.

BACKGROUND OF THE INVENTION

The use generally of interior liners in garments to wick moisture away from the wearer is known.

U.S. Pat. No. 5,435,014, issued Jul. 25, 1995, discloses a garment in the form of shorts which incorporates a suspended moisture management multi-layered panel within the interior thereof for wicking moisture from the skin during garment wear. The suspended panel is attached at one end thereof to a front waist area of the garment and attached at a second end thereof to a back seat area of the garment, the panel passing under the lower crotch area of the wearer.

U.S. Pat. No. 3,813,697, issued Jun. 4, 1974, discloses a pair of pants comprising two hip pieces, front and back wings joined to lateral edges of the hip portions and a waistband portion. Vertical front and back seams join right and left sides of the garment, each comprising a hip portion, a front wing and a back wing. Opposite lateral edges of the hip pieces have upper portions that are convexly curved and diverge from a median axis and lower portions that are approximately straight. In one embodiment the waistband portion is formed by integral portions joining the front and back wings on each side. In another embodiment the waistband is a separate piece. The pants may have short legs or long legs.

U.S. Pat. No. 4,462,118, issued Jul. 31, 1984, discloses a method for assembling pants from two substantially identical fabric panels using flat plane seams for joining the two panels. The pants are assembled according to the sequential steps of first positioning one of the panels in a plane, then overlaying the other of the panels on the first panel. Then the crotch seam regions of the first panel are joined to the corresponding overlying crotch seam regions of the second panel to form two flat plane segments of the crotch seam. Then, the leg portion of one of the panels is folded 180 degrees about a first fold axis which passes through the junction points of the contiguous inseam and crotch regions of the panel. Thereafter, the panels are folded 180 degrees about a second fold axis passing between the first and second sides, so that the inseam regions of each panel are mutually adjacent. Finally, the adjacent inseam regions are joined thereby forming the flat plane inseam, and also joining the two segments of the crotch seam to form flat plane crotch seam. With this configuration, the pants are formed with the two panels entirely with the flat plain seam joining techniques.

U.S. Pat. No. 3,435,462, issued Apr. 1, 1969, discloses a trouser construction including a pair of pant leg elements each having an upper edge which at the front portions thereof extends to the waist, and which curves downwardly and rearwardly from the portion to extend across the seat thereof along a line parallel to the rear of the waist, the side and rear portions of the upper edges of the leg elements being interconnected to a yoke element commencing at the outer ends of the upper edge of each of the leg elements, and extending rearwardly therearound.

U.S. Pat. No. 2,663,876, issued Dec. 29, 1953, discloses a body garment and cargo pocket for the garment.

U.S. Pat. No. 5,297,296, issued Mar. 29, 1994 discloses a multi-layer moisture management elastic fabric including a moisture transport fabric layer constructed of hydrophobic yarns and defining a first fabric face for residing in skin contact during garment wear and for wicking moisture away from the skin. A moisture dispersal fabric layer is constructed of hydrophilic yarns and defines a second fabric face for residing in spaced-apart relation from the skin during garment wear and for receiving moisture from the hydrophobic moisture transport layer. The patent teaches the use of the multi-layer moisture management elastic fabric in the construction of men's briefs as well as other types of garments.

None of the above-identified patents teach the combination of structural elements disclosed and claimed herein which cooperate in a unique manner to provide a garment particularly suitable for hiking, climbing or other strenuous activities and which allow a backpack or waist belt to be worn comfortably when in engagement with the garment.

DISCLOSURE OF INVENTION

The present invention relates to a garment for wear by an individual. The garment includes an upper garment portion formed of a single piece of fabric having the general configuration of a truncated cone and including an open top end for positioning about an individual's waist and a hip covering segment flaring outwardly from the open top end for surrounding the individual's body in the vicinity of the individual's hips and including segment areas positionable over the individual's hips.

A lower garment portion is also incorporated in the garment and the lower garment portion is formed of fabric secured to and extending downwardly from the hip engagement segment of the upper garment portion for positioning about the individual's legs.

The embodiment of the invention disclosed herein includes a liner formed of flexible material disposed within the upper garment portion having liner areas in registry with the segment areas of the upper garment portion for positioning on the individual's hips. The liner has the general configuration of a truncated cone and is free of join seams in the liner areas. The segment areas of the upper garment portion are also free of join seams.

The garment of the present invention is particularly useful when carrying a backpack. Prior art garment constructions typically incorporate join seams in the areas of the hips which can cause rubbing and discomfort where the backpack engages the hip in the vicinity of hip bones. The garment of the present invention does not employ join seams in the hip bone area. The garment also includes pocket defining structure which is so positioned that the edges of the pockets employed in the garment do not engage the hip in the hip bone area and cause problems with backpacks or with belts.

If the garment incorporates a lining, it is utilized to wick moisture away from the entire hip area and is of one piece. Thus there are no lining join seams that could interfere with comfortable use of a backpack or belt. The configurations of the upper garment portion and the liner (when the latter is employed) lessen the likelihood that wrinkles will be formed over the hip bones and become potential sources of irritation when engaged by a backpack or belt.

Other features, advantages and objects of the present invention will become apparent with reference to the following description and accompanying drawings.

BEST MODE FOR CARRYING OUT THE INVENTION

Figure 1:
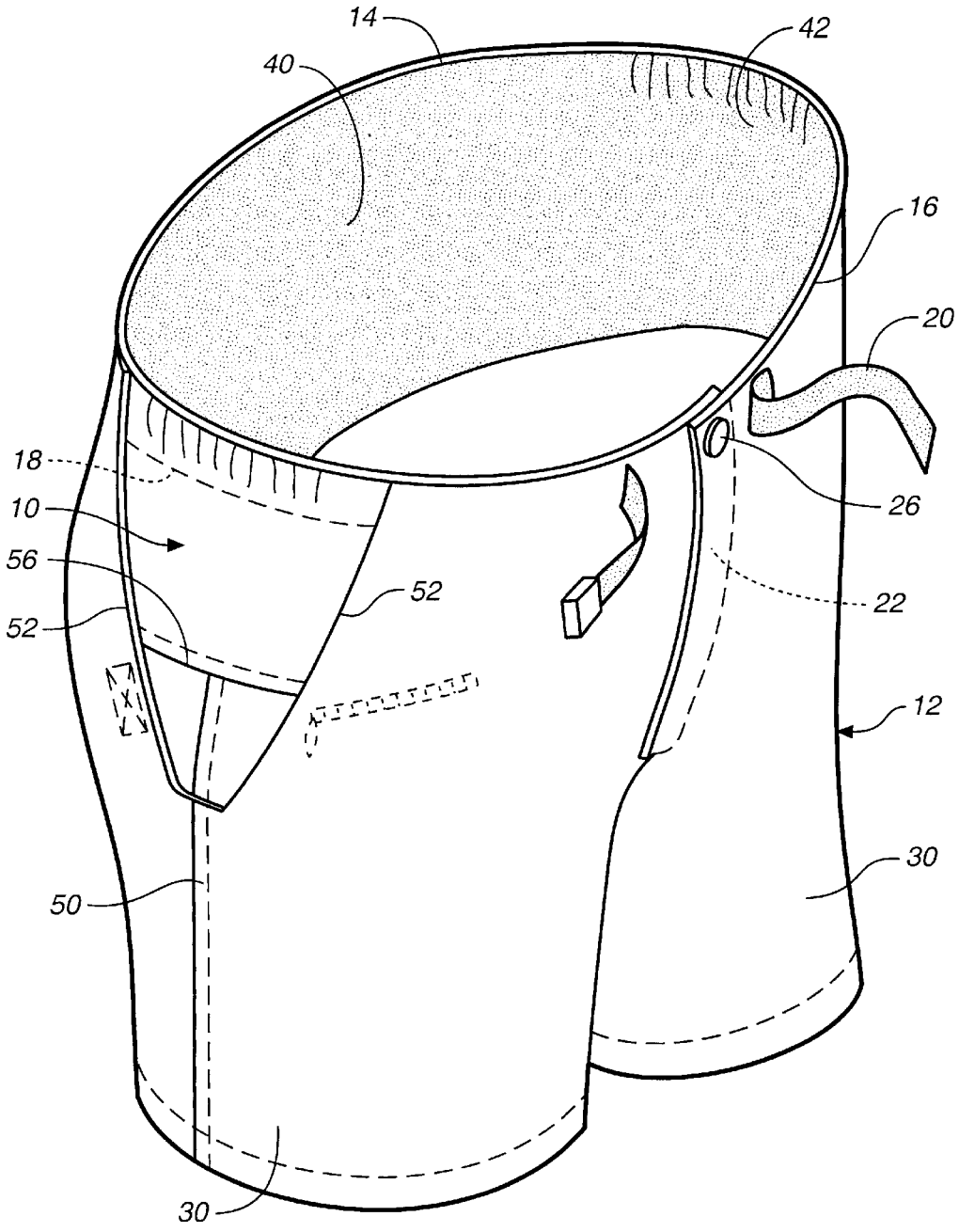
FIG. 1 is a perspective view of a pair of shorts constructed in accordance with the teachings of the present invention and showing the fly thereof closed.

Referring now to the drawings, a pair of shorts constructed in accordance with the teachings of the present invention is illustrated. The principles of the present invention are applicable to other forms of garments such as long pants or trousers and skirts or skirt-like garments.

The illustrated shorts include an upper garment portion 10 and a lower garment portion 12, said garment portions being integrally formed of any suitable fabric, nylon being but one example. The upper garment portion 10 has a truncated cone-like configuration and includes an open top end 14 for positioning about an individual's waist and a hip covering segment 16 flaring outwardly from the open top end for surrounding the individual's body in the vicinity of the individual's hips. The hip covering segment includes segment areas 18 positionable over the individual's hips in the vicinity of the hip bones.

Figure 2:
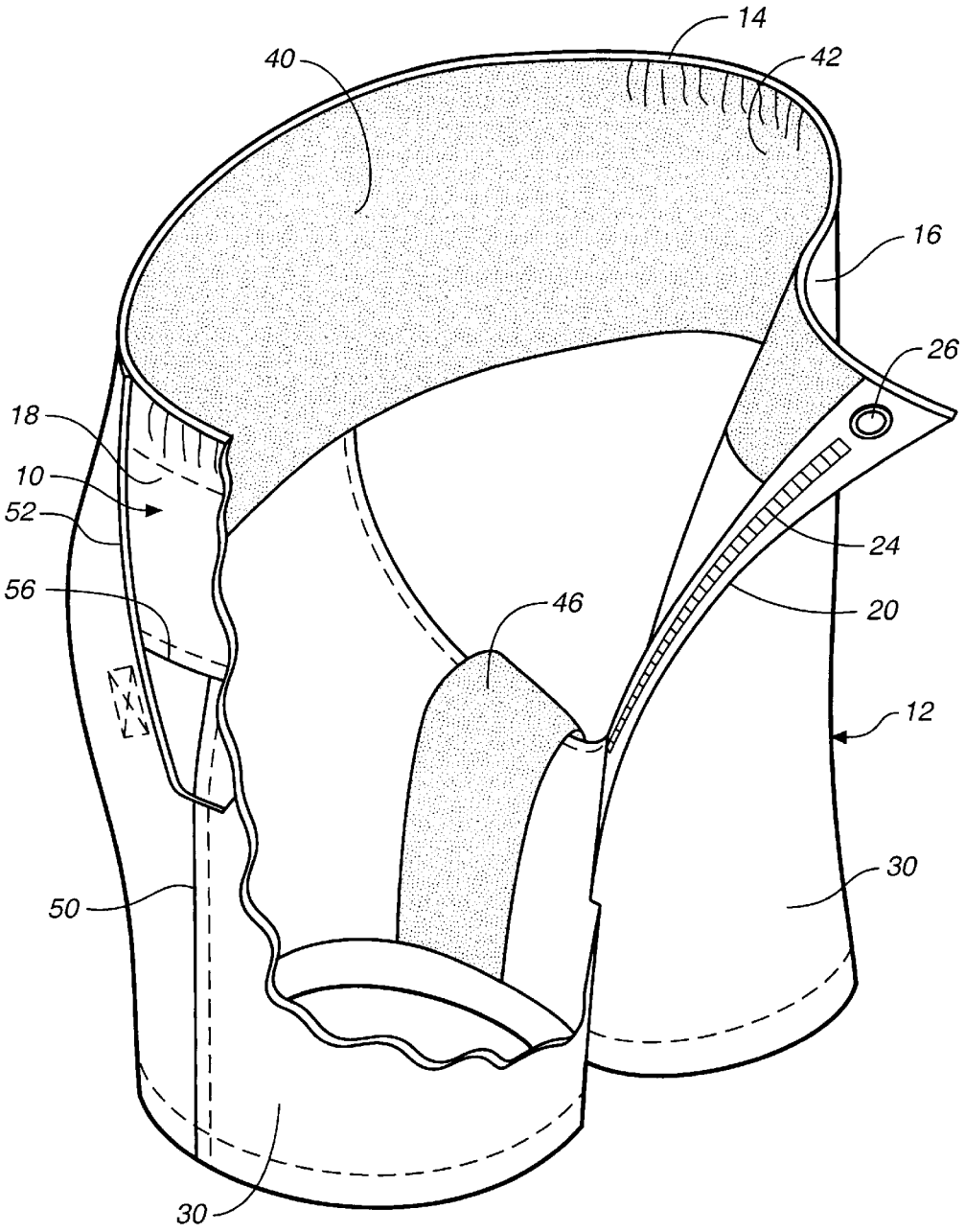
FIG. 2 is a perspective view of the shorts with a portion thereof being broken away to disclose the interior and illustrating the fly open.
Figure 4:
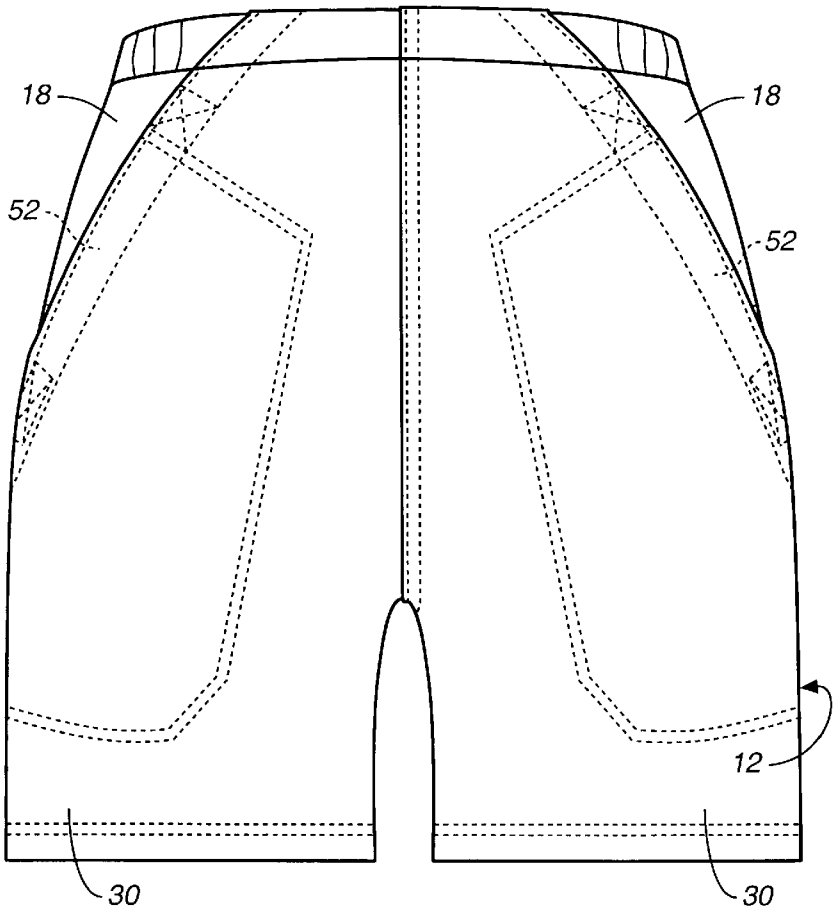
FIG. 4 is a rear elevational view of the shorts.
Figure 3:
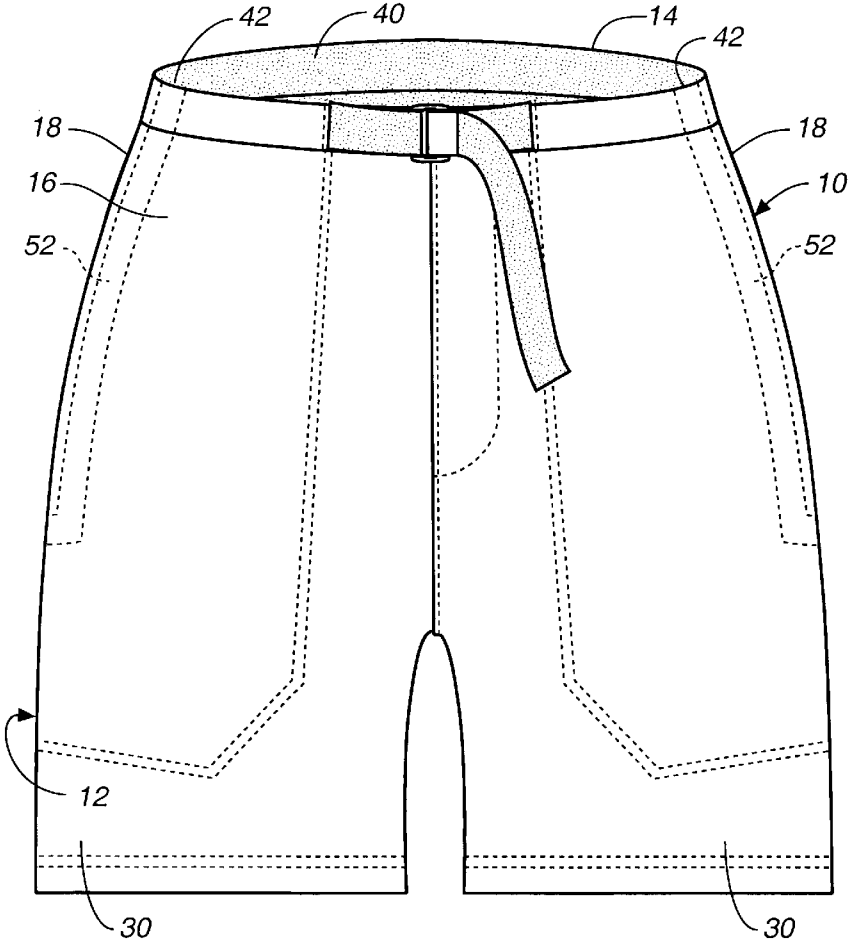
FIG. 3 is a front elevational view of the shorts.
Figure 6:
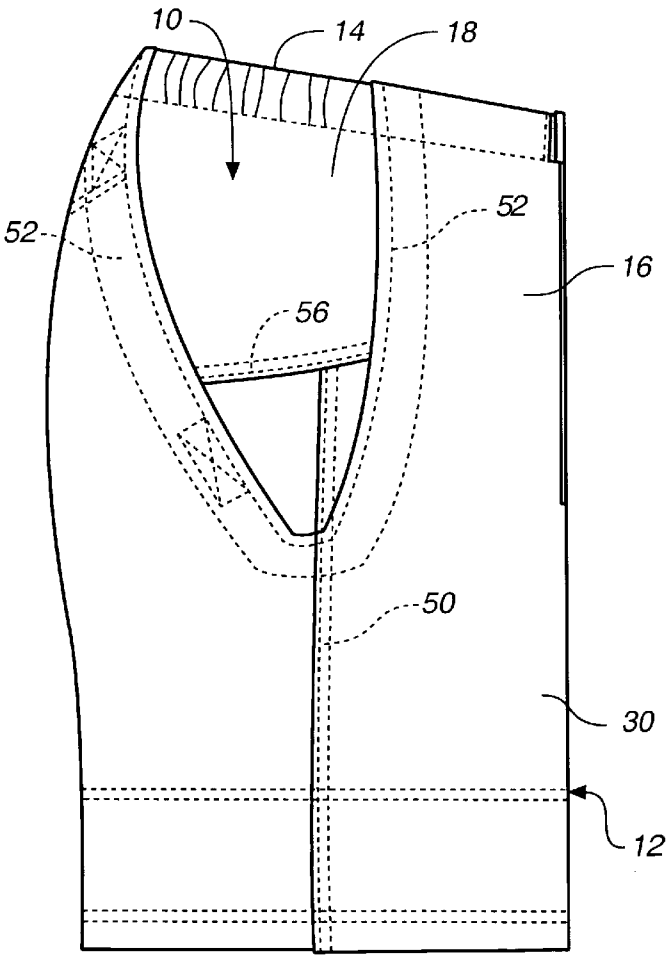
FIG. 6 is a right side elevational view of the shorts.
Figure 5:
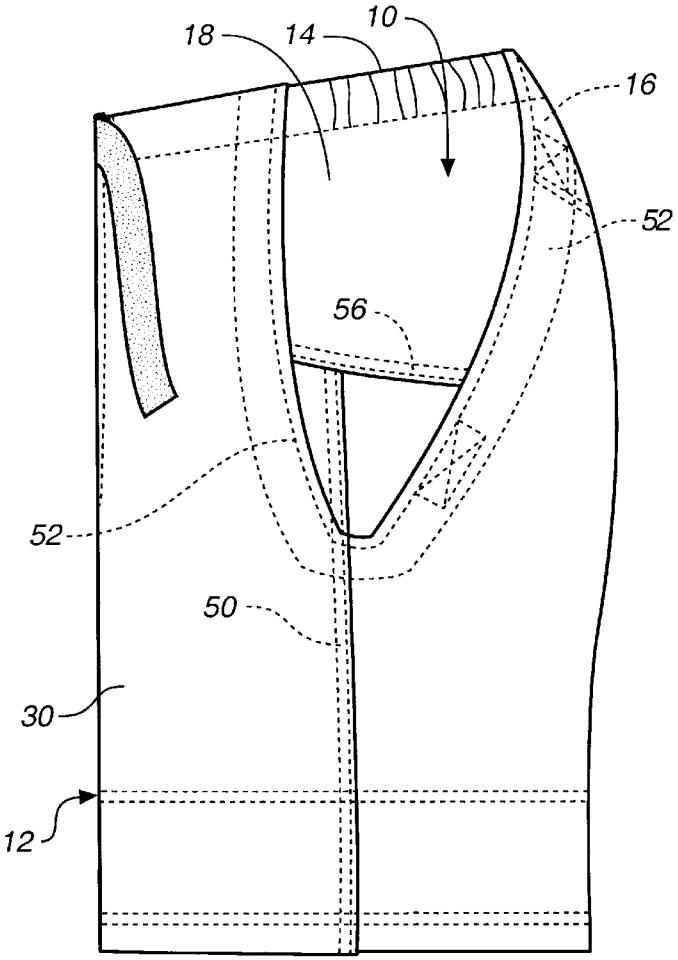
FIG. 5 is a left side elevational view of the shorts.
Figure 7:
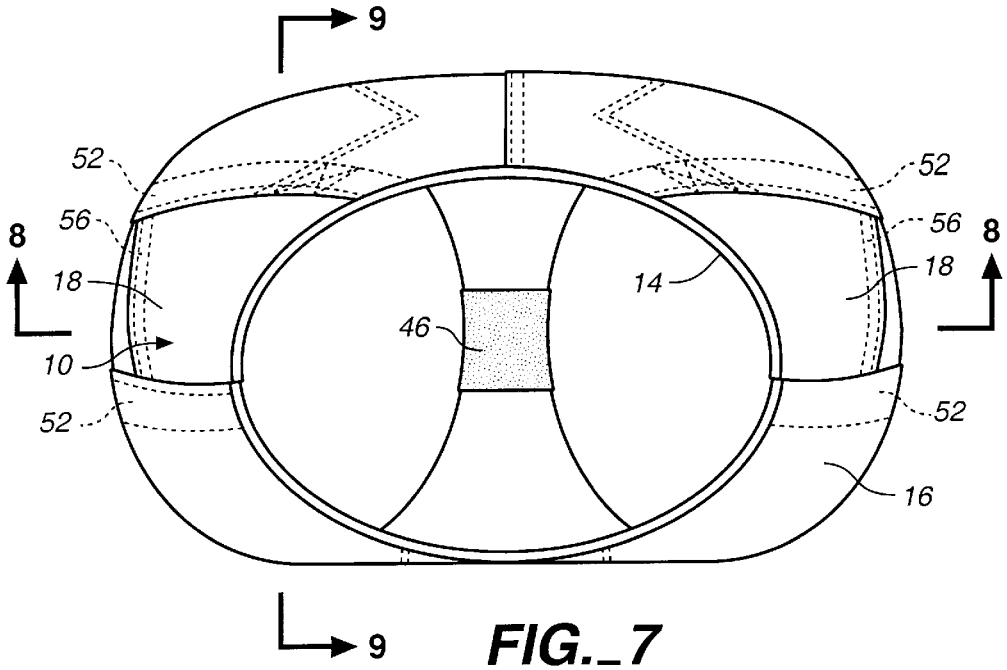
FIG. 7 is a top plan view of the shorts.
Figure 8:
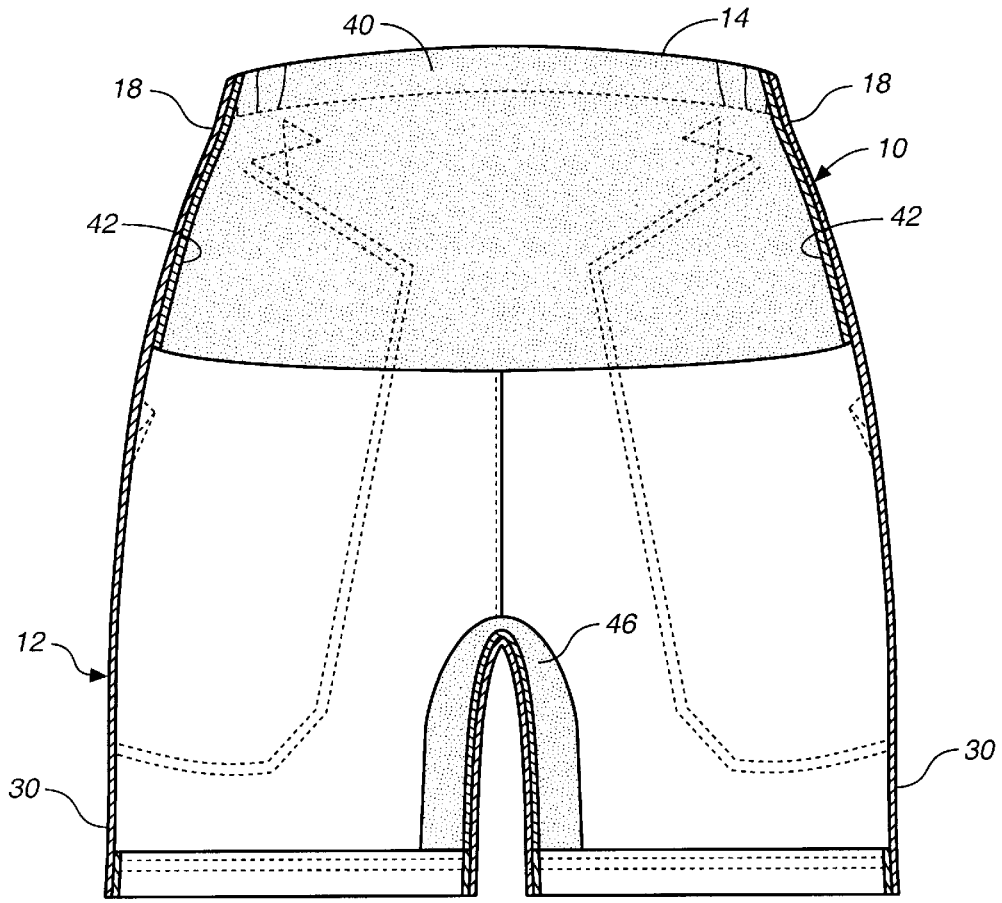
FIG. 8 is a cross-sectional view taken along the line 8—8 in FIG. 7.
Figure 9:
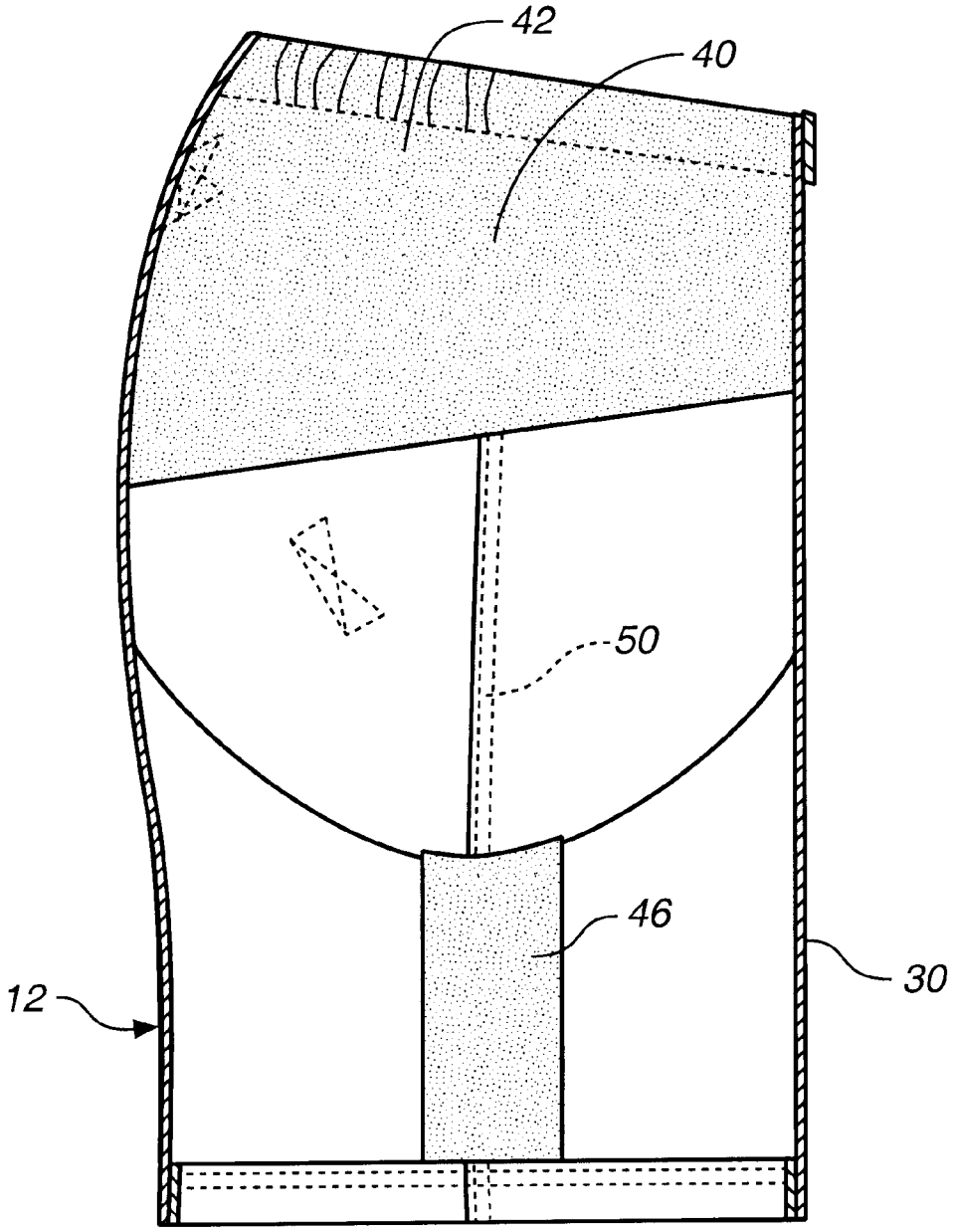
FIG. 9 is a cross-sectional view taken along the line 9—9 of FIG. 7.

In the arrangement illustrated, the top end of the upper garment portion is elasticized at the area of the segment areas 18 and the garment incorporates a tie or belt 20 for tightening the top of the garment. The upper garment portion may be formed of suitable commercially available stretch-type material if desired. The garment includes a fly having an opening 20 (FIG. 2) and a fly flap 22. Suitable closure means such as zipper 24 and snap fastener 26 are utilized to secure the fly in closed condition.

The lower garment portion includes two shorts legs 30 for positioning about the legs of the individual wearing the shorts in a conventional manner.

A liner 40 is disposed within upper garment portion 10 and is secured thereto as by means of sewing. The liner 40 is of integral, unitary construction being formed from a single piece of wicking fabric such as brushed polyester. The liner, like the upper garment portion, has the general configuration of a truncated cone. The liner includes liner areas 42 which are in registry with the segment areas 18 of the upper garment portion. The liner areas 42 and segment areas 18 are located at the upper hip bone area of the wearer's hips. Both the segment areas 18 and the liner areas 42 are free of join seams. This results in no join seams of the garment being located at the hip bone area which could cause discomfort and irritation by a backpack (not shown) worn by the wearer of the shorts. It is common for hiking shorts and trousers to incorporate side join seams which extend over the hip bone area and which grind into the hips under the pressure of a backpack when in use, causing irritation and discomfort.

The liner wicks moisture from the garment wearer's body to the upper garment portion. The illustrated inner liner has no join seams all the way around, being of one piece. The ends of the liner terminate at opposed sides of the fly opening 20 where very little pressure is applied by the backpack belt. Furthermore, no bones are located at this position. The shape of the liner also helps to maintain the fit of the pair of shorts so that the shorts do not form wrinkles over the hip bones. The liner will typically extend about six inches or so downwardly from the open top end of the garment and cover the entire hip area. If desired, and as shown in the drawings, the garment may also incorporate another moisture wicking liner 46 in the crotch area of the garment.

The shorts in the embodiment illustrated include front and rear panels joined by side vertical join seams 50 located at opposed sides of the garment at the lower garment portion 12 below the locations of the segment areas 18 of the upper garment portion and the liner areas 42. The front and rear panels include pocket defining structure forming pockets 52 with the edges of the pockets defining pocket openings at the sides of the garment. The pocket defining structure extends laterally upwardly from the vertical join seams in the direction of the open top end 14. The pocket defining structure is secured to the hip covering segment 16 by being sewn thereto at the pocket edges at locations spaced from the segment areas 18.

There are a pair of pockets 52 at each side of the shorts. The edges and pocket openings of each pair of pockets diverge away from one another from their associated vertical join seam 50 in the direction of the open top end 14. The pocket defining structure at each side of the garment is sewn or otherwise secured to the hip covering segment adjacent to the open top end at two locations spaced from the segment areas 18. One of the locations is located in front of a segment area and one of the locations is located in back of the segment area. That is, the pocket defining structure including pocket edges will not be located at the hip bone area of the wearer of the shorts and will not be engaged by a backpack in the hip bone area.

The disclosed garment has a generally horizontal join seam 56 extending completely around the garment. The horizontal join seam is spaced from the open top end 14 and secures a bottom edge of the upper garment portion 10 to the lower garment portion 12. Each side vertical join seam 50 terminates at join seam 56. The join seams 50, 56 are all disposed away from the segment areas 18 and liner areas 42 so that they will not present a problem insofar as a backpack or belt is concerned.

What is claimed is:

1. A garment for wear by an individual, said garment comprising, in combination:

an upper garment portion formed of fabric and including an open top end for positioning about an individual's waist and a hip covering segment flaring outwardly from said open top end for surrounding the individual's body in the vicinity of the individual's hips and including segment areas positionable over the individual's hips;

a lower garment portion formed of fabric extending downwardly from the hip engaging segment of said upper garment portion for positioning about the individual's legs; and a liner formed of flexible material disposed within said upper garment portion and having liner areas in registry with said segment areas for positioning on the individual's hips, said liner having the general configuration of a truncated cone and being free of join seams in said liner areas.

2. The garment according to claim 1 wherein the segment areas of said upper garment portion are free of join seams.

3. The garment according to claim 1 wherein the flexible material of said liner comprises a wicking material for transferring moisture from the individual's body to said upper garment portion.

4. The garment according to claim 3 wherein said wicking material comprises polyester.

5. The garment according to claim 4 wherein the fabric of said upper garment portion has a truncated cone-like configuration and flares outwardly in a downward direction toward said lower garment portion.

6. The garment according to claim 1 wherein said liner is of one piece construction.

7. The garment according to claim 6 wherein said liner is attached to said upper garment portion and wherein said upper garment portion includes a fly opening, said liner having liner ends terminating at opposed sides of said fly opening.

8. The garment according to claim 1 wherein said garment includes front and rear panels joined by generally vertical join seams located at opposed sides of said garment at said lower garment portion below the locations of the segment areas of said upper garment portion and said liner areas.

9. The garment according to claim 8 wherein said front and rear panels include pocket defining structure including pocket edges forming pockets having pocket openings at the sides of said garment, the pocket edges of said pocket defining structure extending laterally upwardly from said generally vertical join seams in the direction of said open top end, the pocket edges of said pocket defining structure being secured to said hip covering segment at locations spaced from said segment areas.

10. The garment according to claim 9 wherein said pocket defining structure defines a pair of pockets at each side of said garment, the pocket edges of the pockets of each pair of pockets diverging away from one another from a vertical join seam in the direction of said open top end and said pocket edges at each side of said garment being secured to said hip covering segment adjacent to said open top end at two locations spaced from said segment areas, one of said locations being located in front of a segment area and one of said locations being located in back of a segment area.

11. The garment according to claim 1 wherein said upper and lower garment portions form pants.

12. The garment according to claim 1 wherein said upper and lower garment portions form shorts.

13. The garment according to claim 8 including a generally horizontal join seam spaced from said open top end securing a bottom edge of said upper garment portion to said lower garment portion, said generally vertical join seams terminating at said generally horizontal join seam.

14. A garment for wear by an individual, said garment comprising, in combination:

an upper garment portion formed of fabric and including an open top end for positioning about an individual's waist and a hip covering segment flaring outwardly from said open top end for surrounding the individual's body in the vicinity of the individual's hips and including segment areas free of join seams positionable over the individual's hips; and a lower garment portion formed of fabric extending downwardly from the hip engaging segment of said upper garment portion for positioning about the individual's legs.

15. The garment according to claim 14 additionally comprising a liner formed of flexible material disposed within said upper garment portion and having liner areas in registry with said segment areas for positioning on the individual's hips.

16. The garment according to claim 15 wherein said liner has the general configuration of a truncated cone.

17. The garment according to claim 15 wherein said liner areas are free of join seams.

18. The garment according to claim 15 wherein the flexible material of said liner comprises a wicking material for transferring moisture from the individual's body to said upper garment portion.

19. The garment according to claim 14 wherein said upper garment portion has a truncated cone-like configuration and flares outwardly in a downward direction toward said lower garment portion.

20. The garment according to claim 14 including a generally horizontal join seam spaced from said open top end securing a bottom edge of said upper garment portion to said lower garment portion.

* * * * *